US005321854A

United States Patent [19]

Kronenberger

[11] Patent Number: 5,321,854

[45] Date of Patent: Jun. 21, 1994

[54] HEADWEAR PIECE WITH OPENING TO ACCOMMODATE WEARER'S HAIR

[75] Inventor: Robert A. Kronenberger, Deerfield, Ill.

[73] Assignee: American Needle, Buffalo Grove, Ill.

[21] Appl. No.: 483

[22] Filed: Jan. 5, 1993

[51] Int. Cl.[5] ..... A42B 1/04

[52] U.S. Cl. ..... 2/209.7; 2/195.1; 2/209.3

[58] Field of Search ..... 2/175, 195, 197, 198, 2/209.3, 209.7, 171.4, 171.5, 171.6, 171.7, 171.8, 195.2, 195.3, 195.4; D2/509

[56] References Cited

U.S. PATENT DOCUMENTS

| | | | |
|---|---|---|---|
| 1,614,231 | 1/1927 | Cosgrove | 2/175 |
| 1,624,727 | 4/1927 | Goldberg | 2/209.3 |
| 1,704,576 | 3/1929 | Pellegrino | 2/209.7 |
| 1,996,254 | 4/1935 | Parlow | 2/209.7 |
| 2,864,383 | 12/1958 | Jacks | 2/195 |
| 3,041,628 | 7/1962 | Fish | 2/195 |
| 4,991,237 | 2/1991 | Dwyer | 2/209.7 |
| 4,998,544 | 3/1991 | Obergfell | 2/209.3 |
| 5,170,509 | 12/1992 | Leopold | 2/199 |

FOREIGN PATENT DOCUMENTS

| | | | |
|---|---|---|---|
| 506725 | 10/1954 | Canada | 2/209.3 |

*Primary Examiner*—Clifford D. Crowder
*Assistant Examiner*—Diana L. Biefeld
*Attorney, Agent, or Firm*—Wood, Phillips, VanSanten, Hoffman & Ertel

[57] ABSTRACT

A headwear piece having a crown defining an opening to accept the head of a wearer, with the crown having a top and bottom, front and back, and a peripheral wall having an annular configuration. An opening is provided through the peripheral crown wall to allow passage therethrough of an accumulation of hair on the head of a wearer with the headwear piece in place on the wearer's head.

15 Claims, 2 Drawing Sheets

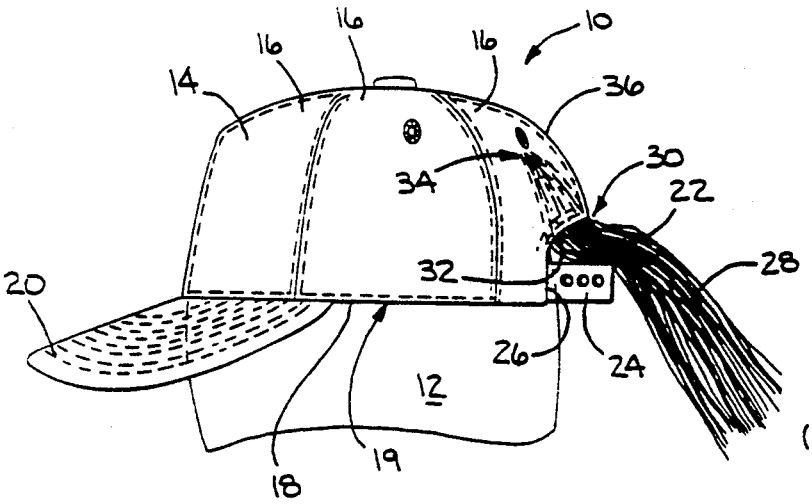
FIG. 1
(PRIOR ART)
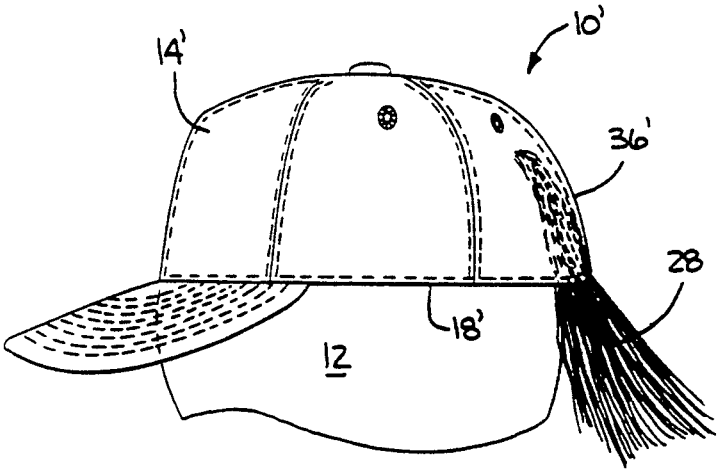
FIG. 2
(PRIOR ART)
FIG. 3
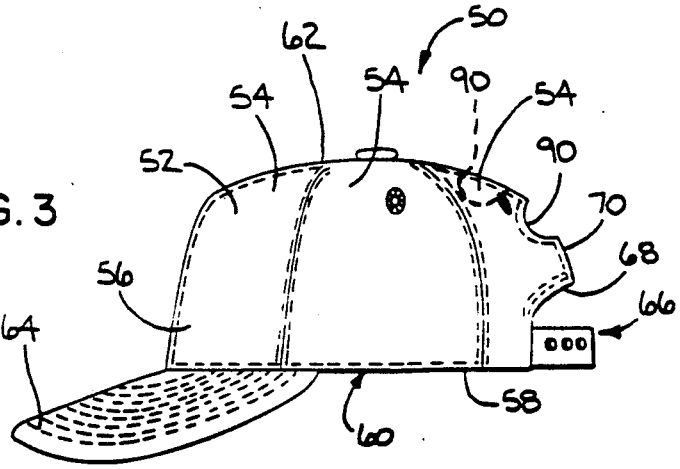

HEADWEAR PIECE WITH OPENING TO ACCOMMODATE WEARER'S HAIR

BACKGROUND OF THE INVENTION

1. Field of the Invention

This invention relates to headwear, and, more particularly, to a headwear piece having a crown with an opening to allow passage therethrough of an accumulation of hair on the head of a wearer.

2. Background Art

Typically, headwear pieces have a crown with a peripheral wall configured to accept and embrace the head of a wearer. The crown may be closed, as with a baseball-style cap, or open, as with a visor.

Baseball-style caps and visors are commonly worn on a casual basis and during the performance of athletics. When users of the headwear have long hair, it is common for them to accumulate the hair, as in a ponytail, to prevent uncontrolled movement of the hair.

When wearing a visor, this accumulation of hair does not present a problem as it can be directed conveniently through the visor opening and draped down the back of the wearer's head and neck. However, with a baseball-style cap, or with other styles of headwear having a closed crown, the accumulated hair interferes with the placement of the headwear on the wearer's head. The accumulated hair may be bunched up on the top of the wearer's head, in which event it prevents the headwear from fully seating on the wearer's head. Alternatively, it may be pulled downwardly to project outwardly from the bottom edge of the crown. However, since the base of the accumulation of the hair at the wearer's head is a significant distance above the bottom edge of the crown, a significant amount of accumulated hair resides between the back of the wearer's head and the back of the crown. This precludes proper fitting of the headwear and may cause considerable discomfort to the wearer.

Certain conventional baseball-style caps have an inverted U-shaped opening at the back of the crown and selectively joinable adjusting straps which can be used to vary the effective crown diameter. The U-shaped opening allows the laterally spaced edges bounding the U-shaped opening to be drawn towards each other through the straps without bunching up of the crown. While the U-shaped opening allows the projection therethrough of an accumulation of hair above the bottom edge of the crown, the U-shaped opening is lower than the base of the accumulation of hair where it departs from the wearer's head so that the accumulated hair must extend downwardly a substantial distance before coinciding with the U-shaped opening. This accumulated hair thus resides between the wearer's head and the crown, as occurs without the U-shaped opening. Although the amount of accumulated hair between the wearer's head and the crown with the U-shaped opening is less than with a headwear piece absent the U-shaped opening, the problems associated therewith still exist.

Aside from creating problems associated with fit, the accumulated hair between the wearer's head distorts the crown and thus detracts from the appearance of the headwear.

SUMMARY OF THE INVENTION

The present invention is specifically directed to overcoming the above enumerated problems in a novel and simple manner.

In one aspect of the invention, a headwear piece is provided having a crown defining an opening to accept the head of a wearer, with the crown having a top and bottom, front and back, and a peripheral wall having an annular configuration. An opening is provided through the peripheral crown wall to allow passage therethrough of an accumulation of hair on the head of a wearer with the headwear piece in place on the wearer's head.

The opening can be strategically located to accept the accumulation of hair at the point where it emanates from the wearer's head. This avoids bunching up of the accumulated hair between the crown of the headwear piece and the wearer's head. Accordingly, the user is allowed to place his or her hair comfortably in a pony tail without effecting the fit of the headwear piece or altering the appearance thereof.

In one form, the opening is completely surrounded by the peripheral wall and has a fixed effective diameter.

The crown may be made either partially or entirely from a flexible fabric, such as with a baseball-style cap.

The peripheral crown wall has a bottom edge and the peripheral crown wall opening is, in one form, spaced at least two inches upwardly from the bottom edge of the peripheral crown wall.

The opening preferably has an effective diameter of at least one inch to as much as three inches. The opening diameter may exceed three inches.

The invention contemplates virtually an infinite number of different opening configurations. For example, the opening may be circular, oval, star-shaped etc. In one form, the opening is elongate laterally of the headwear piece.

The opening may be entirely at the back of the crown or partially at the top of the crown.

The invention further contemplates a headwear piece having a crown defining an opening to accept the head of a wearer, with the crown having a top and bottom, a front and back, a peripheral wall having an annular configuration and a top wall. An opening is provided through at least one of the peripheral crown wall and top wall to allow passage therethrough of an accumulation of hair on the head of a wearer with the headwear piece in place on the wearer's head.

In one form, the crown has laterally spaced sides and the opening in the at least one of the peripheral and top crown walls is spaced approximately midway between the side walls of the crown.

In one form, the opening in the at least one of the peripheral and top crown walls is closer to the back of the crown than to the front of the crown.

The invention further contemplates a headwear piece having a crown defining an opening to accept the head of a wearer, with the crown having a top and bottom, a front and back, a peripheral wall having an annular configuration and a top wall. An opening is provided through at least one of the peripheral crown wall and top wall to allow passage therethrough of an accumulation of hair on the head of a wearer with the headwear piece in place on the wearer's head. The crown has a bottom edge with an opening in the at least one of the peripheral and top crown walls being spaced at least two inches upwardly from the bottom edge of the crown.

In one form, there is a bill on the crown projecting forwardly from the crown to define a baseball-style cap.

In another form, there is a rim depending from the crown and projecting angularly outwardly and downwardly therefrom. The rim may be partially or fully around the circumference of the crown.

In one form, the opening through the at least one of the peripheral crown wall and top wall is the only opening through the crown having an effective diameter of more than ½ inch.

In another form, the crown is made from fabric and the opening through the at least one of the peripheral crown wall and top wall is the only opening through the crown having a diameter of more than ½ inch and fully surrounded by the crown fabric.

BRIEF DESCRIPTION OF THE DRAWINGS

FIG. 1 is a side elevation view of a prior art baseball-style headwear piece in place on a wearer's head and showing an accumulation of hair projecting from a rear cutout that permits size adjustment;

FIG. 2 is a side elevation view of a modified form of prior art baseball-style headwear piece in place on a wearer's head and showing an accumulation of hair projecting downwardly and outwardly from the bottom edge of the headwear piece;

FIG. 3 is a side elevation view of a baseball-style headwear piece having a crown opening according to the present invention;

DETAILED DESCRIPTION OF THE DRAWINGS

Figure 5:
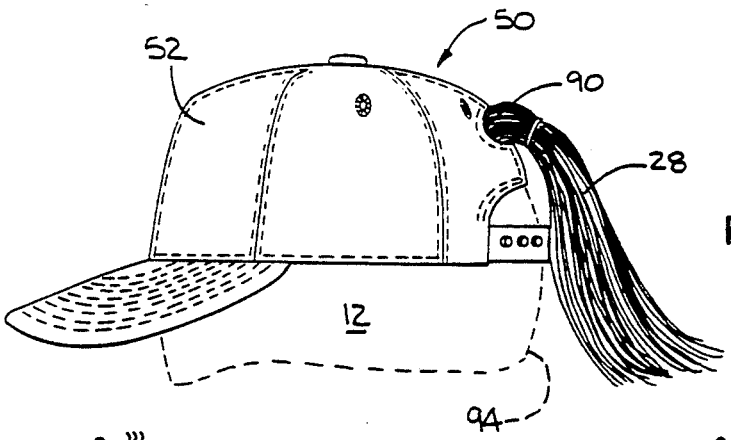
FIG. 5 is a side elevation view of the headwear piece in FIGS. 3 and 4 and showing an accumulation of hair projected outwardly through the crown opening.

In FIG. 1, a prior art headwear piece is shown at 10 in place on a wearer's head 12. The headwear piece 10 has a crown 14 defined by a plurality of gores/panels 16 sewn edge-to-edge to define an inverted cup-shaped configuration with a bottom edge 18 defining a peripheral opening 19 to accommodate the wearer's head 12. A rim/bill 20 projects forwardly and downwardly from the bottom edge 18 of the crown 14 to shield the wearer's face from sun and the elements.

An inverted, U-shaped cutout 22 is defined at the rear of the crown 14 to permit adjustment of the effective diameter of the crown opening 19. An adjustable strap 24 is provided at the bottom of the cutout 22. As discussed in greater detail below, the length of the strap 24 can be altered to vary the spacing between opposite, lateral edges 26 (one shown) to thereby selectively increase and decrease the effective diameter of the crown 24.

The headwear piece 10 is a conventional baseball-style cap which is used for casual wear and during the performance of athletics. Wearers of baseball-style caps with long hair commonly accumulate their hair at the back of the head, as in a ponytail, to prevent uncontrolled movement of the hair, as in windy conditions and when athletic maneuvers are performed. A typical accumulation of hair is shown at 28 in FIG. 1.

With the hair 28 accumulated, the wearer has two basic options for the placement thereof. The accumulated hair 28 can be bunched up and placed fully within the crown, as on the top of a wearer's head. This prevents full seating of the headwear piece 10 on the wearer's head 12. The crown 14 then effectively floats on the hair rather than gripping the wearer's head as is intended by its construction.

Alternatively, and as shown in FIG. 1, the accumulation of hair 28 can be directed through an opening 30 defined cooperatively by the edge 32 of the cutout 22 and the strap 24, as shown in FIG. 1. Because the bulk of the accumulated hair 28 emanates from a point at 34 well above the opening 30, the hair 28 must drape downwardly between the crown 14 and the wearer's head 12 over a substantial distance before it coincides with the opening 30 from where it bends out and downwardly. This accumulation of hair between the back wall 36 and the wearer's head 12 acts as a wedge between the crown 14 and the wearer's head 12. Since the accumulation of hair is localized at the back of the crown 14, the crown 14 may draw the accumulation of hair 28 uncomfortably against the wearer's head 12. Further, the effective size of the crown opening is altered by the hair. This may result in distortion of the crown 14 which thus detracts from the appearance of the headwear piece 10.

As an alternative to passing the accumulated hair 28 through a crown opening 19, as in FIG. 1, the accumulated hair 28 can be passed beneath the bottom edge 18' of the conventional headwear piece 10', shown in FIG. 2. The headwear piece 10' is substantially the same as the headwear piece 10, however the size adjustment cutout 22 and strap 24 are eliminated so that the back wall 36' of the crown 14' is substantially uninterrupted and the headwear piece 10' has a fixed size. With the headwear piece 10' in FIG. 2, the accumulated hair 28 is draped downwardly between the back wall 36' and the wearer's head 12 over a greater height to aggravate the problems associated with the headwear piece 10 in FIG. 1.

Figure 4:
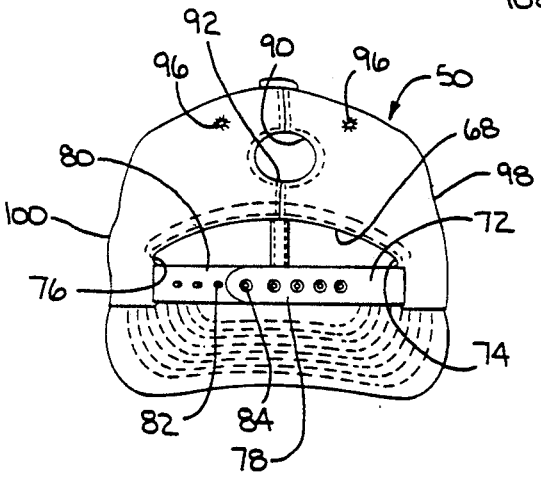
FIG. 4 is a rear elevation view of the headwear piece in FIG. 3.

The headwear piece 50 in FIGS. 3–5, according to the present invention, overcomes the above problems in the prior art headwear pieces 10, 10'. The inventive headwear piece 50 has a crown 52 defined by joined gores/panels 54 to produce an inverted, cup-shaped configuration to accommodate the head of a wearer 12. The gores 54 cooperatively define a peripheral wall 56 with a bottom edge 58 defining an opening 60 to accommodate the head of the wearer 12. The peripheral wall 56 blends into a top wall 62.

A rim/bill 64 projects forwardly and downwardly from the bottom edge 58 of the crown 52 as in the prior art headwear pieces 10, 10'. While the headwear piece 50 is shown to be a baseball-style cap, it should be understood that the invention contemplates incorporation into any headwear piece having a crown. For example, the bill/rim 64 could be extended continuously about the bottom edge 58 of the crown 52 or might be eliminated altogether.

Size adjustment structure is provided at 66. An inverted, U-shaped cutout 68 is provided at the rear 70 of the headwear piece 50. An adjusting strap 72 connects to opposite edges 74, 76 bounding the cutout 68. The strap 72 has cooperating parts 78, 80 that have complementary studs 82 and receptacles 84 that are mated so as to select the overall effective length of the adjusting strap 72. By increasing the amount of overlap of the strap portions 78, 80, the effective length of the strap 72 is reduced, which draws the edges 74, 76 towards each other to diminish the diameter of the crown opening 60.

According to the invention, an opening 90 is provided through at least one of the peripheral wall 66 and top wall 62. The opening 90 is preferably strategically located to coincide with the base of the accumulation of hair 28 where it departs from the wearer's head 12. The bottom 92 of the opening 90 is preferably at least 2 inches upwardly from the bottom edge 58 of the crown 52. As can be seen in FIG. 5, the accumulation of hair 28 passes neatly out of the opening 90 so as not to bunch up between the wearer's head 12 and the crown 52. As a result, the fit of the headwear piece 50 is not altered by the user's having a ponytail or similar accumulation of hair 28. At the same time, there is no distortion of the crown 52 that occurs by reason of the accumulation of the hair 28 in a ponytail with the prior art headwear pieces 10, 10'. Instead, the ponytail neatly drapes over the back 94 of the head 12, as also seen in FIG. 5.

In FIGS. 3-5, the opening 90 is shown to be circular. The opening 90 can have virtually any shape so long as its effective diameter is on the order of one or more inches. The one inch diameter is desired to comfortably accommodate a normal accumulation of hair 28 in a ponytail. The diameter of the opening 90 could be three inches or even larger according to the invention. Preferably, however, it is not greater than three inches.

The terminology "effective diameter" is used to generically define openings 90 of varying shape. For example, in FIG. 9, an opening 90' is shown to be star-shaped. Hair 28 passing through the opening 90' will cause deflection of the flaps 96 in the crown 52' bounding the opening 90'. What is meant when an effective diameter of one inch is described is that a one inch diameter of accumulation of hair can be conveniently passed through the opening without obstruction. In this case, the unobstructed opening may be one inch or the flaps may be readily deformed to enlarge the opening to accommodate the one inch diameter of hair accumulation.

Figure 8:
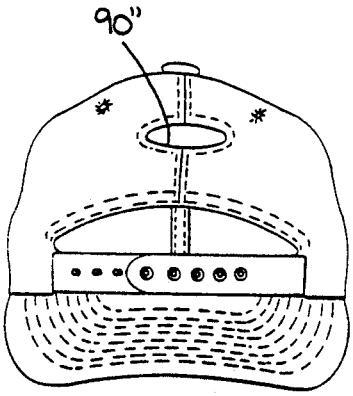
FIG. 8 is a rear elevation view of a further modified form of headwear piece according to the present invention.

It is not necessary to maintain the accumulation of hair 28 precisely in a round shape. In FIG. 8, an oval opening 96'' is shown with a longer lateral dimension. The one inch diameter accumulation of hair 28 could be flattened out to pass through the oval opening 96'' in FIG. 8.

In FIGS. 3-5, the crown 52, which is preferably made from flexible fabric, completely surrounds the opening 92. In FIGS. 3-5, the opening 90 is the only significant opening through the crown 52. Conventional vent holes 96 are usually very small in diameter and do not constitute a significant structural variation.

Figure 9:
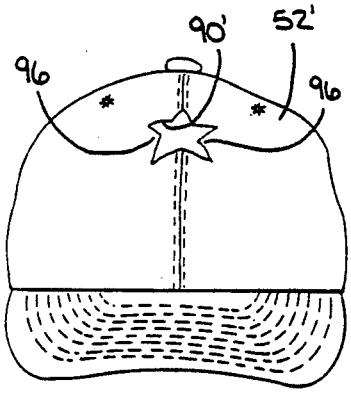
FIG. 9 is a rear elevation view of a still further modified form of headwear piece according to the present invention.

The size adjustment structure 66 can also be eliminated, as shown on the crown 52' in FIG. 9.

The invention further contemplates that while the opening 90 is centered between the sides 98, 100 of the crown 52, the opening 90 could be placed closer to one side than the other. The vertical height of the opening 90 can also be changed to be fully within the peripheral wall 56 or fully within the top wall 62 as shown in dotted lines in FIG. 3.

Figure 6:
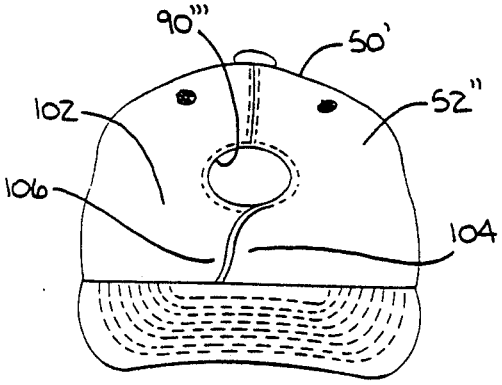
FIG. 6 is a rear elevation view of a modified form of headwear piece according to the present invention with cooperating adjustment flaps thereon in a closed position.
Figure 7:
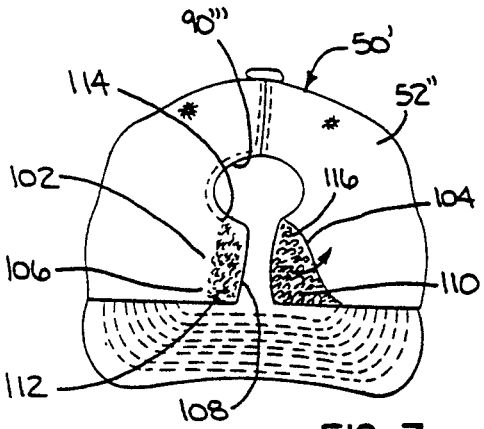
FIG. 7 is a view as in FIG. 6 with the flaps in an open position.

A further modified form of the invention is shown on a headwear piece 50' in FIGS. 6 and 7. In the headwear piece 50', the back wall 102 of the crown 52'' is defined by two overlapping flaps 104, 106. With the flaps 104, 106 separated from each other, an unobstructed entryway 108 is provided on the bottom of the crown 52'' in communication with an opening 90'''. Cooperating hook and loop fasteners 110, 112 are provided with cooperating parts one each on the outside 114 of the flap 106 and on the inside 116 of the flap 106. Accordingly, the extent of overlap of the flaps 104, 106 can be chosen by the user which thereby permits a certain amount of size adjustment for the crown 52''. At the same time, the opening 90''' can be slightly modified by varying the overlap of the flaps 104, 106.

The headwear piece 50' can be put in place by first spreading the flaps 104, 106 to the FIG. 7 configuration so as to allow direction of the ponytail through the entryway 108. This obviates having to thread the accumulated hair 28 through the fully surrounded opening 90'''. Once in place, the accumulated hair 28 can be held up and the flaps 104, 106 mated to serve the dual purpose of closing the opening 90''' and selecting the size for the crown 52'' that is comfortable to the wearer.

The foregoing disclosure of specific embodiments is intended to be illustrative of the broad concepts comprehended by the invention.

I claim:

1. A baseball-style cap comprising:

a crown defining an opening to accept the head of a wearer, said crown having a top and bottom, a front and back, and a peripheral wall having an annular configuration, said crown having an exposed outer surface;

a bill extending angularly forwardly from the crown; and an opening through the peripheral crown wall at the back of the crown to allow rearward passage therethrough of an accumulation of hair on the head of a wearer with the cap in place on a wearer's head.

said peripheral crown wall opening being completely surrounded by the peripheral wall and having an effective diameter that is not greater than three inches, the crown outer surface being substantially uninterrupted by any opening other than peripheral crown wall opening at the back of the crown, wherein the peripheral crown wall has a bottom edge and the bottom of the peripheral crown wall opening is spaced at least two inches upwardly from the bottom edge of the peripheral crown wall.

2. The baseball-style cap according to claim 1 wherein the peripheral crown wall is defined at least partially by a flexible fabric and the flexible fabric completely surrounds the peripheral crown wall opening.

3. The baseball-style cap according to claim 1 wherein the peripheral crown wall opening is substantially round and has an effective diameter of at least one inch.

4. The baseball-style cap according to claim 1 wherein the peripheral crown wall opening has an effective diameter of at least two inches.

5. The baseball-style cap according to claim 1 wherein the peripheral crown wall opening has a fixed diameter.

6. The baseball-style cap according to claim 1 wherein the peripheral crown wall opening is the only opening in the exposed outer surface of the crown having an effective diameter of at least ½ inch.

7. A headwear piece comprising:

a crown defining an opening to accept the head of a wearer and having a front half and a back half, said crown dimensioned to extend from the back to the front of a wearer's head, said crown having a top and bottom, a peripheral wall having an annular configuration and a top wall, said crown having an exposed outer surface; and an opening through the peripheral crown wall fully in the rear half of the crown to allow passage therethrough of an accumulation of hair on the head of a wearer with the headwear piece in place on a wearer's head, said opening through the peripheral crown wall being completely surrounded by the peripheral wall, said crown outer surface being substantially uninterrupted by any opening at the front half of the crown, wherein the peripheral crown wall has a bottom edge and the bottom of the opening through the peripheral wall is spaced at least two inches upwardly from the bottom edge of the peripheral crown wall.

8. The headwear piece according to claim 7 wherein the peripheral and top crown walls are defined at least partially by a flexible fabric and the flexible fabric completely surrounds the opening through the peripheral wall.

9. The headwear piece according to claim 8 wherein means are provided for varying the effective diameter of the opening in the peripheral crown wall.

10. The headwear piece according to claim 7 wherein the opening through the peripheral wall has an effective diameter of at least one inch.

11. The headwear piece according to claim 7 wherein the opening through the peripheral wall has an effective diameter of at least two inches.

12. The headwear piece according to claim 7 wherein the opening through the peripheral wall has an effective diameter that is not greater than three inches.

13. The headwear piece according to claim 7 wherein the crown has laterally spaced sides and the opening in the peripheral wall is spaced approximately midway between the sides of the crown.

14. The baseball-style cap according to claim 7 wherein means are provided on the crown for providing a closable entryway in the crown in communication with the opening through the peripheral wall to allow an elongate ponytail to be placed in the opening through the peripheral wall without threading the ponytail lengthwise into the opening in the peripheral wall.

15. The baseball-style cap according to claim 14 wherein the crown is defined by fabric and the means for providing a closable entryway comprises first and second fabric flaps each defining a portion of the crown outer surface and includes means for joining the flaps in mutually overlying relationship.

* * * * *